US005884406A

United States Patent [19]

Leini

[11] Patent Number: 5,884,406

[45] Date of Patent: Mar. 23, 1999

[54] CHAINSAW GUIDE BAR WHICH STIFFENS WHEN BENT

[75] Inventor: Arvo Leini, Edsbyn, Sweden

[73] Assignee: Sandvik AB, Sandviken, Sweden

[21] Appl. No.: 819,944

[22] Filed: Mar. 18, 1997

[30] Foreign Application Priority Data

Mar. 18, 1996 [SE] Sweden ..... 9601036

[51] Int. Cl.[6] ..... B27B 17/02

[52] U.S. Cl. ..... 30/387; 30/383

[58] Field of Search ..... 30/381, 383, 387, 30/382

[56] References Cited

U.S. PATENT DOCUMENTS

| | | | |
|---|---|---|---|
| 2,660,204 | 11/1953 | Rosenboom | 30/387 |
| 2,962,812 | 12/1960 | Gommel | 30/383 |
| 4,641,432 | 2/1987 | Kume | 30/383 |
| 4,965,934 | 10/1990 | Eriksson et al. | 30/387 |
| 5,014,435 | 5/1991 | Date et al. | 30/387 |
| 5,052,109 | 10/1991 | Vanderzanden et al. | 30/387 |
| 5,561,908 | 10/1996 | Leini | 30/383 |
| 5,596,811 | 1/1997 | Payne | 30/383 |

*Primary Examiner*—Hwei-Siu Payer
*Attorney, Agent, or Firm*—Burns, Doane, Swecker & Mathis, L.L.P.

[57] ABSTRACT

Chain saw guide bar comprising three plates joined by welding, having a nose, a clamping area and a guiding groove for the chain, where the bending stiffness in a zone immediately in front of the clamping area is increased by omitting welds in the zone to make sure that the compressed plate buckles outward when overloaded. The zone extends in the longitudinal direction of the bar for a distance greater than the groove depth and less than the bar width.

7 Claims, 1 Drawing Sheet

CHAINSAW GUIDE BAR WHICH STIFFENS WHEN BENT

BACKGROUND

Chainsaws mounted on tree harvester vehicles usually comprise a saw unit mounted on an articulated arm which can be extended to the tree to be felled. The same saw unit can then also be used for bucking the tree to desired lengths. The saw unit comprises the chainsaw with a saw chain, a guide bar and a motor, as well as gripping arms and feeder wheels to hold and position the tree trunk.

The guide bar is attached to the motor by clamping its clamping end between two clamping blocks. The saw chain runs around the guide bar guided by a groove, and the guide bar edges on each side of the groove usually have at least partially hardened surfaces (i.e., surfaces which are harder than the body of the guide bar) for smooth sliding of the chain for an extended time period.

Tree harvester guide bars are subjected to very great stresses in service, especially if the support of the vehicle against the ground fails, or the gripper arms of the saw unit slip on the tree trunk, with the result that the weight of the tree is transferred to the guide bar. The largest stresses occur immediately in front of the clamping blocks. The guide bar will often be permanently bent in this region when overloaded, and it has always been a desire that bent guide bars should be straightenable for further use. Three obstacles to this goal have been cracking of hardened sliding surfaces, fractures in the welds joining the plates in laminated guide bars, and abrupt local buckling of a guide bar edge into the groove, making it too narrow for the saw chain to pass easily, if at all, therethrough.

Many guide bar designs have been suggested to avoid or reduce these obstacles. Cracks in the sliding surfaces are minimized if the hardening is done only in the regions most subject to wear, as in U.S. Pat. No. 2,962,812, or specifically omitted in the critical region in front of the clamping region as in U.S. Pat. No. 2,897,856. The neighborhood of the oil supply holes within the clamping region covered by the clamping blocks in operation are also preferably unhardened.

Fracture of welds are purported to be minimized if spot welds are made especially close and numerous within the critical region and afterwards annealed as in U.S. Pat. No. 5,052,109, or if the welding is done before total hardening and edge hardening as in SE Patent 469,324. Local buckling is a major disadvantage with guide bars according to U.S. Pat. No. 5,052,109 and will also occur with bars according to SE Patent 469,324, although at a much higher load.

SUMMARY OF THE INVENTION

The present invention is a guide bar which eliminates or mitigates the problems with spot weld fracture and local inward buckling, and is thus safely and easily straightened. The load at which deformation occurs is higher than for other guide bars.

Specifically, the present invention is a chain saw guide bar including three plates joined by welding, the joined plates having a nose, a clamping area, a guiding groove for guiding a saw chain around the contour of the guide bar, and a zone without welds immediately in front of the clamping area. The zone preferably extends in the longitudinal direction of the guide bar for a longer distance than the depth of the groove but for a shorter distance than the width of the guide bar. Parts of the guide bar edges located outside of the zone can have hardened sliding surfaces with parts of the guide bar edges located inside the zone lack hardened sliding surfaces. Further, parts of the guide bar edges within the clamping area immediately behind the zone can lack hardened sliding surfaces. The plates except the sliding surfaces have the same hardness inside the zone as outside the zone in one disclosed embodiment.

BRIEF DESCRIPTION OF THE DRAWINGS

The present invention will now be explained by way of exemplary embodiments to which it is not limited with reference to the accompanying drawing figures in which.

DETAILED DESCRIPTION

Figure 1:
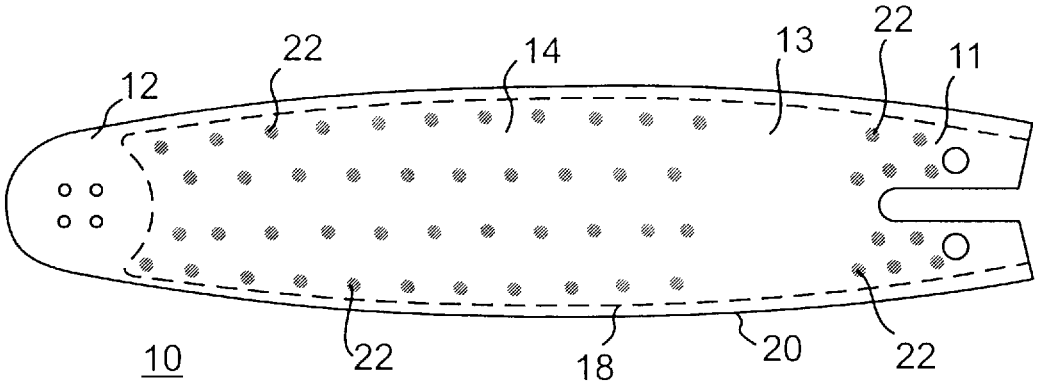
FIG. 1 is a top, plan view of a guide bar in accordance with the present invention.

A guide bar according to the invention is shown in FIG. 1. The guide bar (10) has a clamping end region (11) and a nose (12), usually provided with a nose sprocket. Immediately in front of the clamping end region (11) is a critical region which is most subjected to bending stress. The critical region is shown as a zone (13) extending across the width of the bar (10). Between this zone (13) and the nose (12) is the main cutting region (14) of the bar body where a majority of the cutting action of the saw chain against a tree occurs. The guide bar (10) has a laminated bar body made from two side plates (15, 16) and one center plate (17), the three plates (15, 16, 17) being joined by welding as shown in the figures and exemplified by spot welding.

If the guide bar (10) is subjected to a large loading force at its nose (12) or in the main cutting region (14), a large bending moment is created in the critical zone (13) with reference to a section through the whole bar. Referring to the individual plates, the side plate (15) on the same side as the load is subjected to a large tensile stress, the opposite side plate (16) is subjected to a large compressive stress and the center plate (17) to low average stress.

When a plate is subjected to compressive stress, it will ultimately buckle in a direction where it is least supported when a high enough stress level is reached. This level is strongly dependent on the free length of the plate available for buckling, a shorter length requiring higher stress than a greater length. The stress level depends also on any initial curvature of the plate, with a lower stress level if buckling can occur in the same direction as the initial curvature, and a higher stress level if buckling can only occur in the opposite direction.

Figure 3:
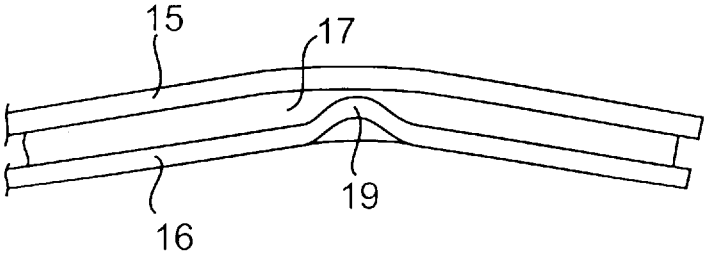
FIG. 3 PRIOR ART
FIG. 3 is a side view of a conventional guide bar in an overloaded condition.

In a known guide bar designs with normal distances between spot welds, or according to U.S. Pat. No. 5,052,109 with very close spot welds in its critical zone, the welds keep the plates supported against each other except for very short lengths between welds. These weld patterns avoid buckling until the stresses reach the elastic limit and then the bar is deformed like a solid bar. One exception is the edge part of the side plate (16) bordering to the chain groove (18) as shown in FIG. 3. This edge part, which forms a side wall of the saw chain guide groove (18), is not supported but is stiffened by its connection to the non-buckling welded parts.

The edge part may be locally buckled with a free length roughly equal to the distance from the sliding surface (20) to the nearest weld. This is a short length, and local buckling will occur at such a high stress level that an abrupt fold (19) is caused, the fold (19) being formed inward into the groove (18). The bar then continues to bend with a constant or slightly lower bending moment.

U.S. Pat. No. 5,052,109 purports to lower the elastic limit so much that the bar is permanently bent before there is any risk of local buckling of the edge, but the maximum load at the nose is then drastically lowered, which is a major disadvantage, and some buckling will still occur. A bar where local buckling of the edge has occurred is shown in FIG. 3. Since the buckling is restricted to the edge part bordering to the groove, it cannot be corrected by hammering or straightening of the welded regions, and the groove is permanently narrowed.

On a guide bar (10) according to the present invention, a plurality of welds (22) are spaced from one another in a longitudinal direction of the guide bar (10). However, the welds are omitted within the critical zone (13), making it possible for the whole compressed side plate (16) including the edges to buckle smoothly outward with a large enough free length (21) corresponding to the longitudinal extent of the zone, that this occurs before there is any local buckling of the edge. When the compressed side plate (16) buckles outward, the effective thickness of the bar increases, and the bending moment increases more rapidly than if no buckling had occurred. Since the edges deform like the rest of the plate, straightening of such a bar is simply done by pressing or hammering of the overlapping parts of the plates, and since the buckling went outward there is no narrowing of the chain groove (18). Further, since the free buckling length (21) is large, there is less risk of cracking of the sliding surfaces (20).

The longitudinal extent of the zone (13) is preferably greater than the distance from the sliding surface (20) to the nearest weld in other portions of the bar which is at least the depth of the groove (18), but smaller than the width of the bar (10). Thus, a zone without welding is defined which extends at least twice the distance between adjacent welds (22) in the longitudinal direction of the guide bar (10).

Figure 2:
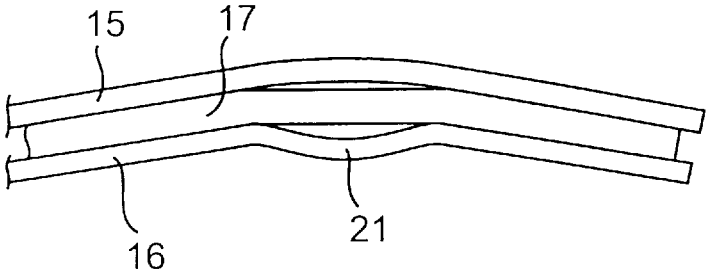
FIG. 2 is a side view of a guide bar in accordance with the present invention in an overloaded condition.

The sliding surface (20) may be hardened all the way around the guide bar (10), but for further reduction of cracks, hardening may be interrupted in the critical zone (13) and some distance in front of and behind the zone (13). The hardness of the plates (15, 16, 17) should preferably be the same within the zone as in other parts (11, 14) of the bar, to ensure that the smooth long outward buckling shown in FIG. 2 occurs at a lower stress level than would be needed for abrupt local buckling as shown in FIG. 3.

The present invention has been described by way of exemplary embodiments to which it is not limited. Other modifications and variations will occur to skilled artisans without departing from the spirit and scope of the invention recited int he claims appended hereto.

What is claimed is:

1. A chain saw guide bar comprising:

three plates joined by a plurality of welds spaced from one another by a given distance in a longitudinal direction of said guide bar, said plates having a nose, a clamping area, a guiding groove for guiding a saw chain around the contour of the guide bar, and a zone without welding immediately in front of the clamping area, said zone extending in the longitudinal direction of the guide bar for at least twice the given distance between adjacent welds in the longitudinal direction.

2. A chain saw guide bar according to claim 1, wherein the zone extends in the longitudinal direction of the guide bar for a longer distance than the depth of the groove.

3. A chain saw guide bar according to claim 1, wherein the zone extends in the longitudinal direction of the guide bar for a shorter distance than the width of the guide bar.

4. A chain saw guide bar according to claim 2, wherein the zone extends in the longitudinal direction of the guide bar for a shorter distance than the width of the guide bar.

5. A chain saw guide bar according to claim 1, wherein parts of the guide bar edges located outside of the zone have hardened sliding surfaces, and parts of the guide bar edges located inside the zone lack hardened sliding surfaces.

6. A chain saw guide bar according to claim 5, wherein parts of the guide bar edges within the clamping area immediately behind the zone lack hardened sliding surfaces.

7. A chain saw guide bar according to claim 5, wherein the plates except the sliding surfaces have the same hardness inside the zone as outside the zone.

* * * * *